US009062362B2

(12) United States Patent
Oikawa et al.

(10) Patent No.: US 9,062,362 B2
(45) Date of Patent: Jun. 23, 2015

(54) PRECIPITATE HARDENING STAINLESS STEEL AND LONG BLADE USING SAME FOR STEAM TURBINE

(75) Inventors: Shinji Oikawa, Hitachi (JP); Hideo Yoda, Hitachi (JP); Masahiko Arai, Hitachinaka (JP); Hiroyuki Doi, Tokai (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 453 days.

(21) Appl. No.: 13/495,386

(22) Filed: Jun. 13, 2012

(65) Prior Publication Data

US 2012/0321478 A1 Dec. 20, 2012

(30) Foreign Application Priority Data

Jun. 16, 2011 (JP) ..... 2011-133798

(51) Int. Cl.

*F01D 5/28* (2006.01)
*C22C 38/50* (2006.01)
*C22C 38/44* (2006.01)

(52) U.S. Cl.

CPC ..... *C22C 38/50* (2013.01); *C22C 38/44* (2013.01)

(58) Field of Classification Search

CPC ..... F01D 5/28; C22C 38/44; C22C 38/50
USPC ..... 416/241 R
See application file for complete search history.

(56) References Cited

U.S. PATENT DOCUMENTS 4,968,357 A * 11/1990 Liu ..... 148/620
6,174,385 B1 * 1/2001 Morinaga et al. ..... 148/325
6,200,685 B1 * 3/2001 Davidson ..... 428/472.1
2006/0118215 A1 6/2006 Hirakawa et al.
2010/0139817 A1 6/2010 Montagnon
2011/0255988 A1 10/2011 Oikawa et al.

FOREIGN PATENT DOCUMENTS

EP 0646653 A1 * 4/1995
EP 1 669 473 A1 6/2006
JP 02-310339 A 12/1990
JP 2005-171339 A 6/2005
JP 2005-194626 7/2005
JP 2008-546912 12/2008
JP 2011-225913 11/2011
WO WO 01/14601 A1 3/2001
WO WO 2006/006810 A1 * 6/2006
WO WO 2007/067134 A1 6/2007

OTHER PUBLICATIONS

EP Search Report of Appln. No. 12172290.4 dated Dec. 17, 2012 in English.

* cited by examiner

*Primary Examiner* — Liam McDowell
(74) *Attorney, Agent, or Firm* — Crowell & Moring LLP

(57) ABSTRACT

As a precipitate hardening stainless steel has excellent structure stability, strength, toughness, and corrosion resistance, requires no sub-zero treating and is excellent in terms of productivity, a long blade for a steam turbine uses the same. The following are provided: a precipitate hardening stainless steel, which comprises C at 0.05 mass % or less, N at 0.05 mass % or less, Cr at 10.0 mass % to 14.0 mass %, Ni at 8.5 mass % to 11.5 mass %, Mo at 0.5 mass % to 3.0 mass %, Ti at 1.5 mass % to 2.0 mass %, Al at 0.25 mass % to 1.00 mass %, Si at 0.5 mass % or less, and Mn at 1.0 mass % or less, and the balance is composed of Fe and inevitable impurities. The long blade for a steam turbine is composed of this precipitate hardening stainless steel.

18 Claims, 9 Drawing Sheets

PRECIPITATE HARDENING STAINLESS STEEL AND LONG BLADE USING SAME FOR STEAM TURBINE

BACKGROUND OF THE INVENTION

The present invention relates to a precipitate hardening stainless steel having excellent structure stability, strength, toughness, and corrosion resistance, which requires no sub-zero treating and thus is excellent in terms of productivity, and a long blade for a steam turbine using the same.

In recent years, in light of energy saving (e.g., conservation of fossil fuel) and global warming prevention (e.g., reduction of $CO_2$ gas generation), improvement of thermal power plant efficiency (e.g., improvement of steam turbine efficiency) has been anticipated. Elongation/enlargement of long blades for steam turbines is an effective means for improving steam turbine efficiency. In addition, elongation/enlargement of long blades for steam turbines allows reduction of the number of cylinders, which can be expected to result in additional effects such as shortening of facility construction time and subsequent cost reduction.

Materials for long blade having excellent mechanical properties and corrosion resistance are required in order to improve steam turbine reliability. Precipitate hardening stainless steels are characterized in that they are excellent in terms of corrosion resistance because they contain large amounts of Cr but small amounts of C; however, their strength and toughness are unbalanced (see, for example, JP Patent Publication (Kokai) No. 2005-194626 A).

Materials that contain increased amounts of precipitate-forming elements to achieve high strength have low martensite finish points (martensite finish temperatures). Such materials are problematic in terms of productivity because, for example, they should be subjected to sub-zero treating via dry ice cooling in order to realize uniform martensitic structure (see, for example, JP Patent Publication (Kokai) No. 2008-546912 A).

SUMMARY OF THE INVENTION

An object of the present invention is to provide a precipitate hardening stainless steel having excellent structure stability, strength, toughness, and corrosion resistance, which requires no sub-zero treating and thus is excellent in terms of productivity, and a long blade for a steam turbine using the same.

The precipitate hardening stainless steel of the present invention comprises C at 0.05 mass % or less, N at 0.05 mass % or less, Cr at 10.0 mass % to 14.0 mass %, Ni at 8.5 mass % to 11.5 mass %, Mo at 0.5 mass % to 3.0 mass %, Ti at 1.5 mass % to 2.0 mass %, Al at 0.25 mass % to 1.00 mass %, Si at 0.5 mass % or less, and Mn at 1.0 mass % or less, and the balance is composed of Fe and inevitable impurities.

According to the present invention, a precipitate hardening stainless steel having excellent structure stability, strength, toughness, and corrosion resistance, which requires no sub-zero treating and thus is excellent in terms of productivity, and a long blade for a steam turbine using the same can be provided.

This specification incorporates the content of the specification of Japanese Patent Application No. 2011-133798, for which priority is claimed to the present application.

DESCRIPTION OF THE EMBODIMENTS

Figure 1:
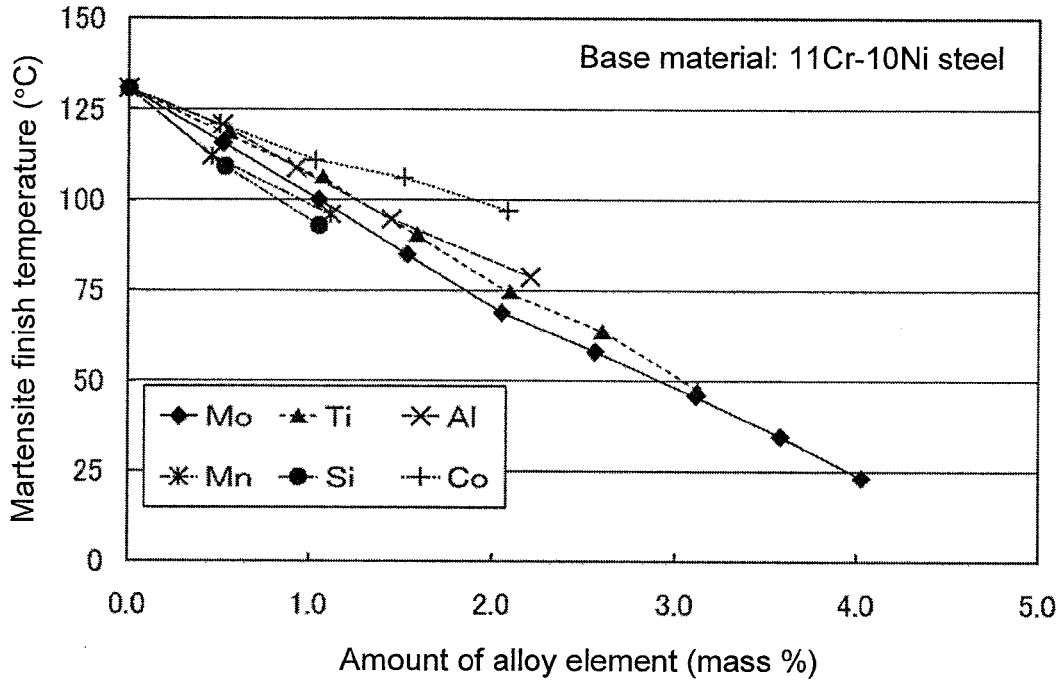
FIG. 1 is a chart showing the relationship between the amount of alloy elements and the martensite finish point.

The roles and amounts of component elements contained in the precipitate hardening stainless steel of the present invention are explained below.

Mass percentage (%) is used to express the amount of a component element in the descriptions below.

Carbon (C) forms chromium carbide. For example, excessive carbide precipitation is problematic because it causes reduction of toughness and Cr concentration in the grain boundary, resulting in poor corrosion resistance. In addition, C causes significant reduction of martensite finish temperature. Thus, reduction of C amount is required. The mass percentage of C to preferably 0.05% or less and more preferably 0.025% or less.

Nitrogen (N) forms TiN or AlN, which causes a reduction of fatigue strength and negatively influences toughness. In addition, N causes significant reduction of martensite finish temperature. Thus, reduction of N amount is required. The mass percentage of N to preferably 0.05% or less and more preferably 0.025% or less.

Chromium (Cr) is an element that causes surface passive state formation so as to contribute to the improvement of corrosion resistance. Sufficient corrosion resistance can be ensured by setting the lower limit of the mass percentage of Cr to 10.0%. Meanwhile, if excess Cr is added, 6 ferrite is formed, resulting in significant deterioration of mechanical properties and corrosion resistance. Thus, the upper limit of the mass percentage of Cr was set to 14.0%. In view of the above, it is required to adjust the mass percentage of Cr to 10.0% to 14.0%, preferably 11.0% to 13.0%, and particularly preferably 11.5% to 12.5%.

Nickel (Ni) is an element that suppresses 6 ferrite formation and contributes to the improvement of strength via precipitate hardening of an Ni—Ti or Ni—Al compound. Ni also contributes to the improvement of hardenability and toughness. In order to sufficiently ensure the above effects, it is required to set the lower limit of the mass percentage of Ni to 8.5%. Meanwhile, if the mass percentage of Ni exceeds 11.5%, it results in residual austenite precipitation, making it impossible to realize desired tensile characteristics. In view of the above, it is required to adjust the mass percentage of Ni to 9.0% to 11.0%, preferably 9.5% to 10.5%, and particularly preferably 9.75% to 10.25%.

Molybdenum (Mo) is an element that improves corrosion resistance. In order to realize target corrosion resistance, it is required to add Mo at an amount that accounts for at least 0.5 mass %. Meanwhile, if the mass percentage of Mo exceeds 3.0%, it promotes 6 ferrite formation, which in turn results in deterioration of characteristics. In view of the above, it is required to adjust the mass percentage of Mo to 0.5% to 3.0%, preferably 1.0% to 2.5%, and particularly preferably 1.5% to 2.0%.

Titanium (Ti) forms a Ni—Ti compound so as to contribute to precipitate hardening. In order to sufficiently secure the above effects, it is required to set the lower limit of the mass percentage of Ti to 1.5% or more. If excess Ti is added, precipitation results in toughness reduction. Thus, the upper limit of the mass percentage of Ti has been determined to be 2.0%. Accordingly, it is required to adjust the mass percentage of Ti to preferably 1.5% to 2.0%, preferably 1.65% to 1.85%, and particularly preferably 1.7% to 1.8%.

Aluminium (Al) is an element that forms an Ni—Al compound so as to contribute to precipitate hardening. In order to realize sufficient precipitate hardening, it is required to add Al at an amount that accounts for at least 0.25 mass %. If the mass percentage of Al exceeds 1.0%, it causes excessive precipitation of an Ni—Al compound and 6 ferrite formation, resulting in reduction of mechanical properties. In view of the above, it is required to adjust the mass percentage of Al to 0.25% to 1.0%, preferably 0.3% to 0.9%, and particularly preferably 0.4% to 0.8%.

Silicon (Si) is a deoxidizer. The mass percentage of Si is preferably 0.5% or less. This is because if the mass percentage of Si exceeds 0.5%, it causes 6 ferrite precipitation, which is problematic. Thus, the mass percentage of Si is more preferably 0.25% or less and particularly preferably 0.1% or less. It is possible to omit addition of Si if carbon vacuum deoxidation and electroslag melting are applied. In such case, it is preferable not to add Si.

Manganese (Mn) is used as a deoxidizer or a desulfurizing agent. The mass percentage of Mn is preferably 1.0% or less. This is because if the mass percentage of Mn exceeds 1.0%, it results in reduction of toughness. Thus, the mass percentage of Mn is more preferably 0.5% or less and particularly preferably 0.25% or less.

Niobium (Nb) is an element that forms carbide so as to contribute to the improvement of strength. If the mass percentage of Nb is less than 0.05%, the effects of Nb cannot be sufficiently exhibited. If it is 0.5% or more, 6 ferrite formation is promoted. In view of the above, it is required to adjust the mass percentage of Nb to 0.05% to 0.5%, preferably 0.1% to 0.45%, and particularly preferably 0.2% to 0.3%.

In addition, either vanadium (V) or tantalum (Ta) can be used instead of Nb. If two or three of Nb, V, and Ta are added in combination, the total amount thereof should be equivalent to the amount of Nb in a case in which only Nb is added. Addition of these elements is not essential; however, it significantly facilitates precipitate hardening.

Tungsten (W), as well as Mo, is effective for improving corrosion resistance. Addition of W is not essential; however, the addition of W in combination with Mo further enhances the improvement of corrosion resistance. In such case, the total amount of Mo and W should be equivalent to the amount of Mo in a case in which only Mo is added in order to prevent δ ferrite precipitation.

Cobalt (Co) is effective for suppressing δ ferrite formation so as to improve stability of martensitic structure. As the amount of Co increases, it causes residual austenite precipitation, making it impossible to realize desired tensile characteristics. Thus, the upper limit of the mass percentage of Co is preferably 1.0%.

Rhenium (Re) is an element that improves strength via solution strengthening and contributes to the improvement of toughness and corrosion resistance. However, Re is very expensive and thus the upper limit of the mass percentage of Re is preferably 1.0% in terms of cost efficiency.

The term "inevitable impurity" used herein refers to a component that is originally contained in a raw material or is accidentally (but not intentionally) mixed in the stainless steel of the present invention during the production process. Examples of inevitable impurities include P, S, Sb, Sn, and As, at least one of which is contained in the stainless steel of the present invention.

In addition, it is preferable to minimize the mass percentages of P and S such that toughness can be improved without loss of tensile characteristics. In view of the improvement of toughness, it is preferable to achieve the following conditions: P: 0.5 mass % or less; and S: 0.5 mass % or less. It is particularly preferable to achieve the following conditions: P: 0.1 mass % or less; and S: 0.1 mass % or less.

Toughness can be improved by reducing As, Sb, and Sn. Thus, it is desirable to minimize the mass percentages of these elements. Preferably, the following conditions are satisfied: As: 0.1 mass % or less; Sb: 0.1 mass % or less; and Sn: 0.1 mass % or less. Particularly preferably, the following conditions are satisfied: As: 0.05 mass % or less; Sb: 0.05 mass % or less; and Sn: 0.05 mass % or less.

Even if the composition satisfies the above conditions for the individual components, the following parameters A and B are required to be satisfied at the same time in order to realize uniform martensitic structure via water cooling.

$$A=127.7-4.20\text{Cr}\,\%-6.38\text{Ni}\,\%-3.09\text{Mo}\,\%-2.67\text{Al}\,\%-14.7\text{W}\,\%-3.41\text{Mn}\,\%-3.57\text{Si}\,\%-1.65\text{Co}\,\%-2.32\text{Ti}\,\%-221.5\text{C}\,\%-321.4\text{N}\,\%\geq 2.5$$

$$B=(\text{Cr}\,\%+2.2\text{Si}\,\%+1.1\text{Mo}\,\%+0.6\text{W}\,\%+4.3\text{Al}\,\%+2.1\text{Ti}\,\%)/(\text{Ni}\,\%+31.2\text{C}\,\%+0.5\text{Mn}\,\%+27\text{N}\,\%+1.1\text{Co}\,\%)\leq 2.0$$

Parameter A relates to martensite finish temperature. As shown in FIG. 1, the coefficient was determined by experimentally evaluating the effects of elements of the steel of the present invention (based on a 11Cr-10Ni steel) upon martensite finish temperature. As a result, it was found that every alloy element tends to decrease martensite finish temperature. In particular, such tendency was clearly observed for C and N. In order to adjust the martensite finish temperature to 25° C. or more, it is preferable to employ a composition that allow parameter A to be 2.5 or more while the conditions of components of the steel of the present invention are satisfied.

Parameter B relates to martensitic structure stability. Parameter B is preferably 2.0 or less to realize complete martensitic structure while the above conditions of components of the steel of the present invention are satisfied. In such case, δ ferrite in the structure is degraded via solution treatment that is carried out at 925° C. to 1025° C. as described below. In addition, the term "uniform martensitic structure" used herein means a structure in which δ ferrite or residual austenite is contained at 1.0 mass % or less. As a result of precipitation of δ ferrite and residual austenite, characteristics such as tensile strength are reduced. In view of safety, the acceptable volume percentage of such precipitate was determined to be 1.0% or less.

As described above, an alloy having high degrees of strength, toughness, and corrosion resistance, which has a uniform martensitic structure formed via water cooling, can be obtained by selecting a composition which satisfies the condition that parameter A is 2.5 or more and parameter B is 2.0 or less.

Next, heat treatment of the present invention is described below.

According to the present invention, solution treatment comprising heating at 925° C. to 1025° C. and desirably 950° C. to 1000° C. and rapid cooling is required. The term "solution treatment" used herein refers to heat treatment for dissolving components involved in precipitate formation (e.g., Al and Ti) in the structure, and at the same time, realizing martensitic structure. In addition, δ ferrite contained in the structure is degraded in this step as described above. After solution treatment, aging treatment comprising heating at 500° C. to 600° C. and rapid cooling is required. The term "aging treatment" used herein refers to heat treatment for achieving excellent strength by causing fine precipitation of an Ni—Al or Ni—Ti compound or the like in the structure, which is carried out after solution treatment.

The use of the alloy of the present invention for long blades for a steam turbine is described below. Although the step of shape processing or straightening can be carried out after aging treatment, when the step is carried out immediately after solution treatment at which no precipitation of an Ni—Al or Ni—Ti compound or the like would be observed, high working efficiency can be expected as a result of good machinability.

A Co-based alloy can be joined via TIG welding to the blade tip portion of a long blade for a steam turbine composed of the alloy of the present invention. This is intended to protect the long blade for a steam turbine from erosion that causes destruction of the blade due to the impact of high-speed condensed steam. After TIG welding, SR (Stress Relief) treatment at 550° C. to 575° C. and desirably 560° C. to 570° C. is required in order to remove residual stress that causes crack generation. Examples of other joining means include silver alloy brazing and overlaying welding with the use of a plasma transfer arc. Another means for protecting long blades for a steam turbine from erosion is surface modification via nitriding. In addition, the alloy of the present invention has erosion resistance to some extent. Thus, it is possible to omit the above anti-erosion step if the state of erosion is not serious.

Figure 2:
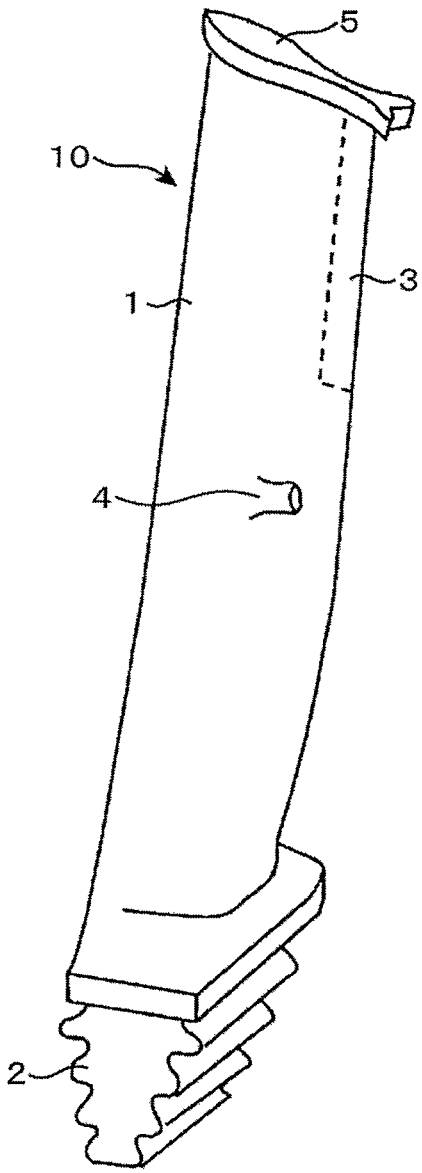
FIG. 2 schematically shows a perspective view of an example of the long blade for a steam turbine of the present invention.

FIG. 2 shows a long blade 10 for a steam turbine, which is composed of the alloy of the present invention. The long blade is composed of a blade profile portion 1 that receives steam, a blade root 2 that allows the blade to become engaged with the rotor, a stub 4 by which the blade is integrated with an adjacent blade via torsion, and a continuous cover 5. The long blade for a steam turbine is an axial-entry-type blade having a blade root in an inverse Christmas-tree shape. In this case, a Co-based alloy plate is used as an example of the erosion shield 3 and is jointed to the blade.

Figure 3:
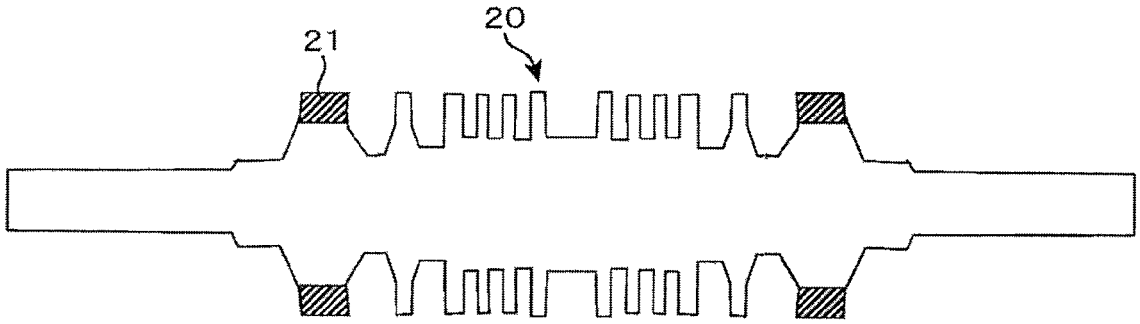
FIG. 3 schematically shows an example of the low-pressure stage rotor of the present invention.

FIG. 3 shows a low-pressure stage rotor 20 to which the long blades of the present invention are applied. This low-pressure stage rotor is used for a double-flow turbine. In this case, the long blades are installed in a symmetric manner to long blade brackets 21 for use with a plurality of stages. The long blade shown in FIG. 2 is provided to the last stage.

Figure 4:
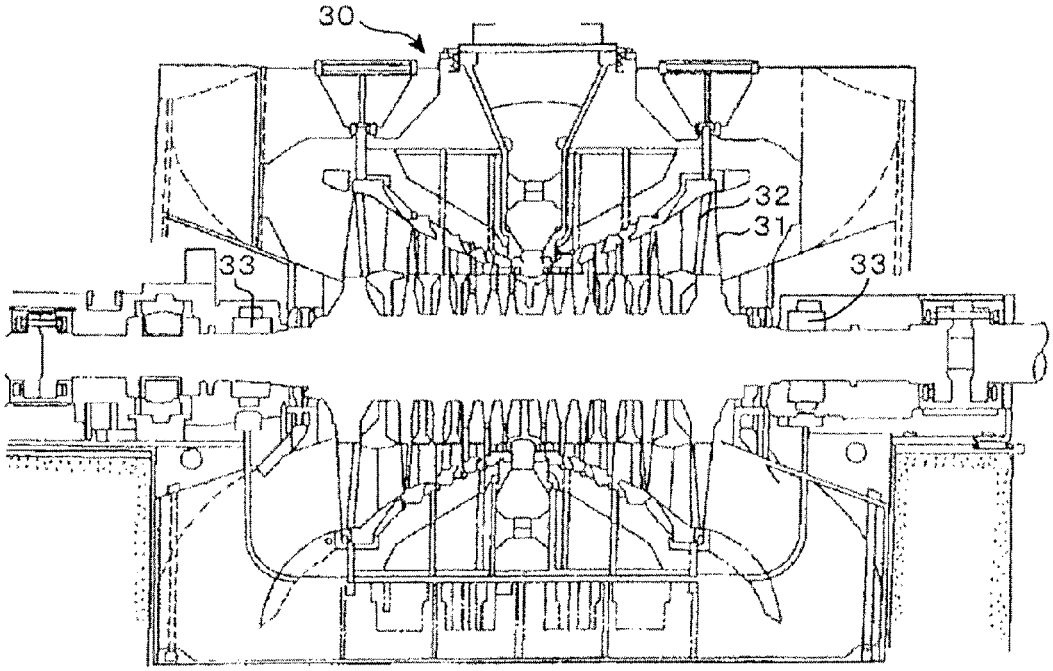
FIG. 4 schematically shows an example of the low-pressure stage turbine of the present invention.

FIG. 4 shows a low-pressure stage steam turbine 30 to which the low-pressure stage rotor of the present invention is applied. Steam discharged from a nozzle 32 is sent to a long blade 31 for a steam turbine, resulting in rotation of the long blade. The rotor is supported by a bearing 33.

Figure 5:
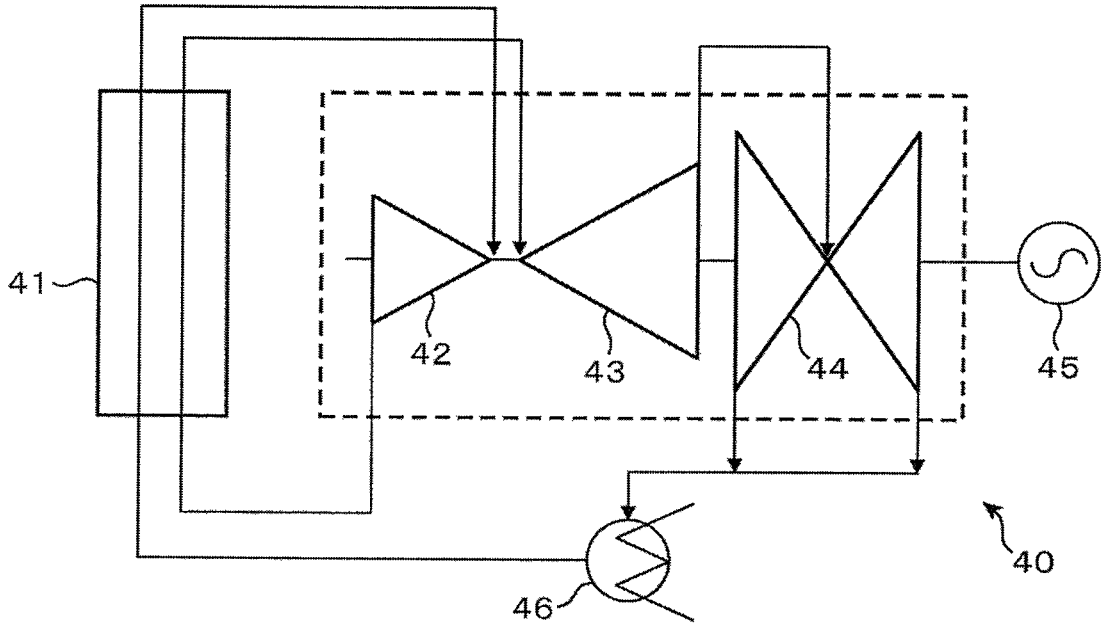
FIG. 5 schematically shows a power plant using the low-pressure stage steam turbine.

FIG. 5 shows an operational diagram of a power plant 40 provided with the low-pressure stage steam turbines of the present invention. High-temperature and high-pressure steam generated in a boiler 41 does work in a high-pressure turbine 42 and is then reheated in the boiler. Reheated steam does work in a middle-pressure turbine 43 and also in a low-pressure stage turbine 44. Work generated in the steam turbines is converted into electric power by a generator 45. Steam discharged from the low-pressure stage turbine is sent to a condenser 46.

The present invention is described below with the reference to the Examples.

EXAMPLES

Example 1

Test samples of the precipitate hardening stainless steel of the present invention were prepared to evaluate the relationship between chemical composition and tensile strength, 0.02% yield stress, Charpy impact strength, pitting potential, microstructure observation, and martensite finish point. Table 1 lists the chemical compositions of the test samples.

First, raw materials were melted in a high frequency vacuum melting furnace ($5.0\times10^{-3}$ Pa or less, 1600° C. or more) so as to result in the compositions listed in table 1. The obtained ingots were subjected to hot forging using a press forging machine and a hammer forging machine so that they could be shaped into square bars (width×thickness×length=120 mm×30 mm×1500 mm). Next, each square bar was subjected to cut process to prepare a stainless steel starting material (width×thickness×length=60 mm×30 mm×120 mm).

Then, the obtained stainless steel starting materials were subjected to various types of heat treatment using a box electric furnace. Alloys 1 to 21 were heated at 980° C. for 1 hour for solution heat treatment and immersed in water at room temperature for rapid water cooling. Subsequently, the alloys were heated at 510° C. for 2 hours for aging heat treatment and then removed from the furnace to be exposed to the air at room temperature for air cooling.

The thus obtained samples were subjected to evaluation tests to determine tensile strength, Charpy impact strength, pitting potential, microstructure observation, and the martensite finish point. The outline of each evaluation test is explained below.

For determination of tensile strength and 0.02% yield stress, a tensile test was performed at room temperature according to JIS Z 2241 using test pieces (parallel body length: 30 mm; outside diameter: 6 mm) prepared from the samples obtained above. Tensile strength and 0.02% yield stress results were determined to be "Accepted" if found to be 1200 MPa or more and 900 MPa or more, respectively, or "Rejected" if either one of them is below the level.

For determination of Charpy impact strength, a Charpy impact test was performed at room temperature in accordance with JIS Z 2242 using test pieces prepared from the samples obtained above in which each test piece has a 2-mm V notch. Charpy impact strength results were determined to be "Accepted" if found to be 20 J or more or "Rejected" if found to be below the level.

For evaluation of pitting potential, plate-like test pieces (length: 15 mm; width: 15 mm; thickness: 3 mm) were prepared from the samples obtained above. A 3.0% NaCl solution was used as a test solution. Evaluation was carried out at a solution temperature of 30° C. and a sweep rate of 20 mV/min. Pitting potential results were determined to be "Accepted" if found to be 150 mV or more or "Rejected" if found to be below the level.

Microstructure observation was carried out using an optical microscope. The observation results were determined to be "Accepted" for a sample having a uniform martensitic structure and containing the precipitate of the δ ferrite phase and the residual austenite phase at 1.0 mass % or less, respectively. Results other than the above results were determined to be "Rejected." The mass percentage of the precipitate of the δ ferrite phase and that of the precipitate of the residual austenite phase were determined by the point counting method of JIS G 0555.

Thermodilatometry was carried out for evaluation of martensite finish point. Cylindrical test pieces (φ3.0×L10) were prepared and treated according to the temperature cycle of heating at from 0° C. to 980° C., maintaining the temperature at 980° C. for 30 minutes, and cooling to −100° C. Evaluation was carried out in an argon atmosphere at a heating rate of 100° C./min or at a cooling rate of −100° C./min. The accepted martensite finish point was determined to be 25° C. or more.

Table 2 shows test results for each material.

Acceptable results were obtained for alloys 1 to 11 of the present invention in terms of mechanical characteristics such as tensile strength, 0.02% yield stress, and the Charpy impact strength. Favorable results were also obtained in terms of pitting potential. In addition, it was confirmed that a uniform martensitic structure was formed as a result of water cooling while neither the δ ferrite phase nor the residual austenite phase was found in the metal structure. The martensite finish points were found to be 25° C. or more, which were also accepted.

In the case of alloy 12, each component fell within the predetermined range. However, parameter A was below 2.5 and the martensite finish point was 25° C. or less, which were rejected.

In the case of alloy 13, each component fell within the predetermined range. However, parameter B exceeded 2.0 and the mass percentage of δ ferrite precipitate in the structure was 1.0% or more, which were rejected. Tensile strength and 0.02% yield stress results were also rejected.

In the cases of alloys 14 and 15, the pitting potential and the martensite finish temperature tended to decrease as the amount of C increased and thus both of the results were rejected. Particularly in the case of alloy 15, the mass percentage of the residual austenite precipitate in the structure was 1.0 mass % or more, and tensile strength and 0.02% yield stress results were low. Thus, the results were rejected.

In the cases of alloys 16 and 17, Charpy impact strength and martensite finish temperature tended to decrease as the amount of N increased and thus both of the results were rejected. Particularly in the case of alloy 17, the mass percentage of the residual austenite precipitate in the structure was 1.0% or more, and tensile strength and 0.02% yield stress results were significantly low. Thus, the results were rejected.

In the case of alloy 18, the amount of Cr exceeded the upper limit of the predetermined range. The mass percentage of the δ ferrite precipitate was 1.0% or more, and tensile strength, 0.02% yield stress, and martensite finish temperature results were rejected. In the case of alloy 19, the amount of Ni exceeded the upper limit of the predetermined range. The mass percentage of the residual austenite precipitate was 1.0% or more, and tensile strength, 0.02% yield stress, and martensite finish temperature results were rejected.

In the case of alloy 20, the mass percentage of the δ ferrite precipitate was 1.0% or more, and the amount of Al exceeded the upper limit of the predetermined range. In addition, Charpy impact strength and martensite finish temperature results were rejected.

In the case of alloy 21, the amount of Ti exceeded the upper limit of the predetermined range. The mass percentage of the δ ferrite precipitate was 1.0% or more, and Charpy impact strength and martensite finish temperature results were rejected.

Figure 6:
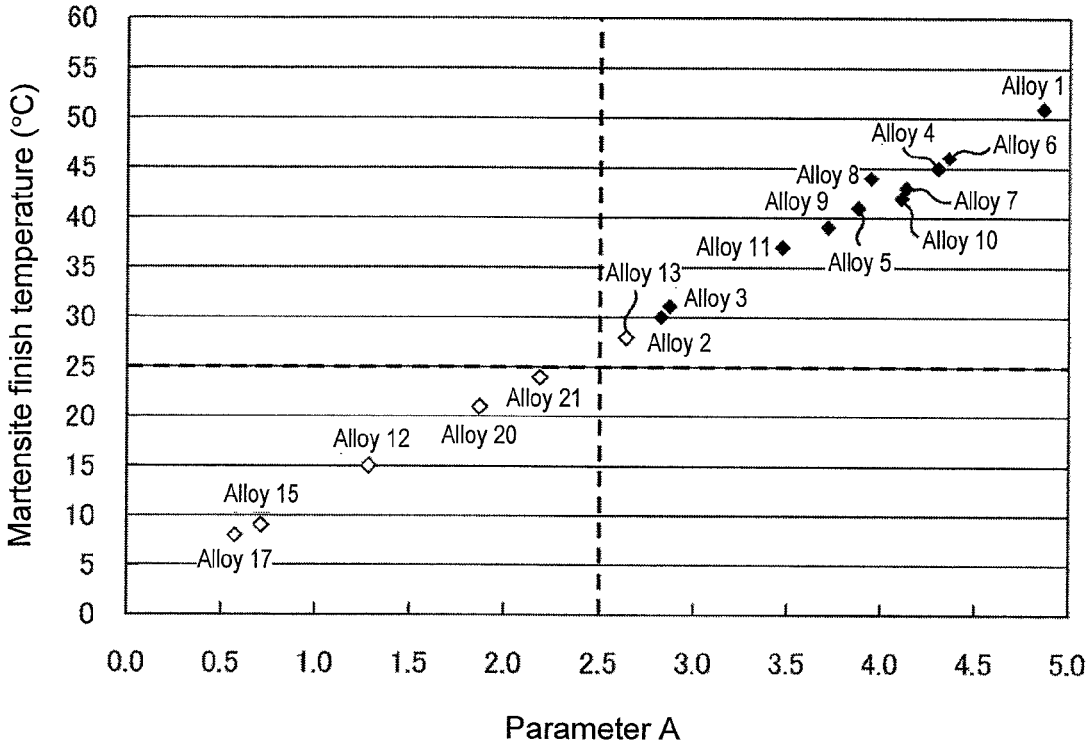
FIG. 6 is a chart showing the relationship of parameter A and the martensite finish point for the alloys of the present invention.

FIG. 6 is a chart showing the relationship between parameter A and martensite finish temperature. The martensite finish temperature tends to linearly increase proportionally to parameter A. Therefore, parameter A is required to be 2.5 or more in order to achieve a martensite finish point of 25° C. or more according to the object of the present invention.

Figure 7:
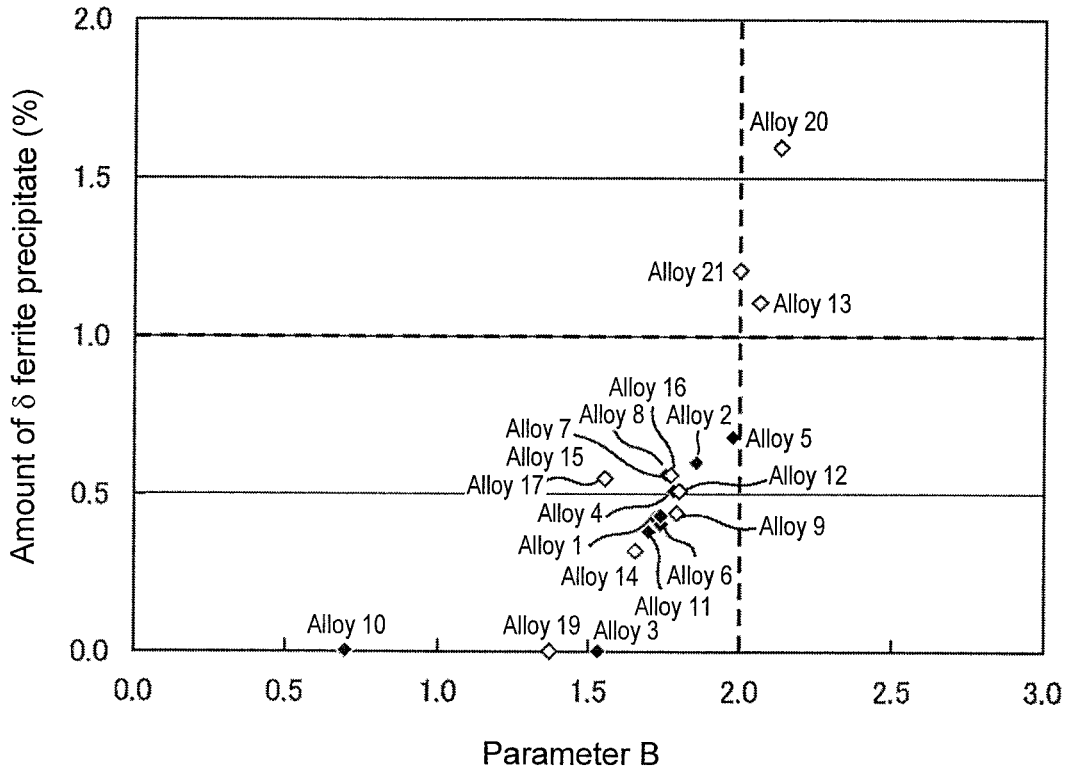
FIG. 7 is a chart showing the relationship of parameter B and the mass percentage of δ ferrite precipitate for the alloys of the present invention.

FIG. 7 is a chart showing the relationship between parameter B and the amount of δ ferrite precipitate. The amount of δ ferrite precipitate tends to linearly increase proportionally to parameter B. Therefore, parameter B is required to be 2.0 or less in order to achieve a mass percentage of δ ferrite precipitate of 1.0% or less according to the object of the present invention.

TABLE 1

| Category | No. | Parameter A | Parameter B | Martensitic transformation termination temperature | Component (wt %) C | Cr | Ni | Si | Mn | Al |
|---|---|---|---|---|---|---|---|---|---|---|
| Invented alloy | Alloy 1 | 4.9 | 1.7 | 51 | 0.018 | 11.2 | 9.7 | 0.002 | 0.05 | 0.38 |
| | Alloy 2 | 2.8 | 1.9 | 30 | 0.013 | 12.5 | 9.5 | 0.002 | 0.06 | 0.28 |
| | Alloy 3 | 2.9 | 1.5 | 31 | 0.012 | 10.9 | 10.6 | 0.002 | 0.04 | 0.29 |
| | Alloy 4 | 4.3 | 1.8 | 40 | 0.017 | 11.1 | 9.8 | 0.002 | 0.05 | 0.55 |
| | Alloy 5 | 3.9 | 1.9 | 41 | 0.018 | 11.2 | 9.6 | 0.002 | 0.05 | 0.93 |
| | Alloy 5 | 4.4 | 1.7 | 46 | 0.018 | 11.3 | 9.7 | 0.002 | 0.05 | 0.33 |
| | Alloy 7 | 4.1 | 1.8 | 43 | 0.017 | 11.2 | 9.8 | 0.002 | 0.06 | 0.35 |
| | Alloy 8 | 3.9 | 1.8 | 44 | 0.016 | 11.2 | 9.7 | 0.002 | 0.05 | 0.27 |
| | Alloy 9 | 3.7 | 1.7 | 39 | 0.018 | 11.8 | 9.7 | 0.002 | 0.05 | 0.33 |
| | Alloy 10 | 4.1 | 0.7 | 42 | 0.017 | 11.5 | 9.6 | 0.002 | 0.05 | 0.28 |
| | Alloy 11 | 3.5 | 1.7 | 37 | 0.016 | 11.8 | 9.7 | 0.002 | 0.05 | 0.32 |
| Comparative alloy | Alloy 12 | 1.3 | 1.8 | 15 | 0.016 | 12.1 | 9.8 | 0.002 | 0.04 | 0.33 |
| | Alloy 13 | 2.6 | 2.1 | 28 | 0.012 | 13.0 | 9.1 | 0.002 | 0.04 | 0.35 |
| | Alloy 14 | 0.6 | 1.7 | 8 | 0.031 | 11.5 | 9.8 | 0.002 | 0.05 | 0.30 |
| | Alloy 15 | −2.5 | 1.6 | — | 0.055 | 11.3 | 9.6 | 0.002 | 0.05 | 0.28 |
| | Alloy 16 | 0.7 | 1.8 | 9 | 0.016 | 11.6 | 9.7 | 0.002 | 0.04 | 0.33 |
| | Alloy 17 | −11.7 | 1.8 | — | 0.017 | 11.5 | 9.5 | 0.002 | 0.05 | 0.31 |
| | Alloy 18 | −7.8 | 2.2 | — | 0.014 | 15.1 | 9.3 | 0.002 | 0.06 | 0.38 |
| | Alloy 19 | −10.3 | 1.4 | — | 0.017 | 11.2 | 12.2 | 0.002 | 0.05 | 0.33 |
| | Alloy 20 | 1.9 | 2.1 | 21 | 0.016 | 11.6 | 9.7 | 0.002 | 0.05 | 1.25 |

TABLE 1-continued

| | | | | | | | | | | |
|---|---|---|---|---|---|---|---|---|---|---|
| Alloy 21 | 2.2 | 2.1 | 24 | | 0.016 | 11.8 | 9.5 | 0.002 | 0.04 | 0.39 |

| | | Component (wt %) | | | | | | | |
|---|---|---|---|---|---|---|---|---|---|
| Category | No. | P | S | Mo | W | Ti | N | Co | V |
| Invented alloy | Alloy 1 | 0.002 | 0.002 | 1.41 | — | 1.61 | 0.002 | — | — |
| | Alloy 2 | 0.002 | 0.002 | 1.29 | — | 1.60 | 0.001 | — | — |
| | Alloy 3 | 0.002 | 0.002 | 1.28 | — | 1.58 | 0.001 | — | — |
| | Alloy 4 | 0.002 | 0.002 | 1.43 | — | 1.63 | 0.002 | — | — |
| | Alloy 5 | 0.002 | 0.002 | 1.46 | — | 1.61 | 0.002 | — | — |
| | Alloy 5 | 0.002 | 0.002 | 1.36 | — | 1.77 | 0.002 | — | — |
| | Alloy 7 | 0.002 | 0.002 | 1.39 | — | 1.97 | 0.001 | — | — |
| | Alloy 8 | 0.002 | 0.002 | 2.11 | — | 1.57 | 0.001 | — | — |
| | Alloy 9 | 0.002 | 0.002 | 0.75 | 0.78 | 1.64 | 0.001 | — | — |
| | Alloy 10 | 0.002 | 0.002 | 1.36 | — | 1.55 | 0.002 | 0.55 | — |
| | Alloy 11 | 0.002 | 0.002 | 1.35 | — | 1.60 | 0.001 | — | 0.31 |
| Comparative alloy | Alloy 12 | 0.002 | 0.002 | 1.41 | — | 1.69 | 0.001 | — | — |
| | Alloy 13 | 0.002 | 0.002 | 1.44 | — | 1.68 | 0.001 | — | — |
| | Alloy 14 | 0.002 | 0.002 | 1.38 | — | 1.71 | 0.001 | — | — |
| | Alloy 15 | 0.002 | 0.002 | 1.35 | — | 1.74 | 0.001 | — | — |
| | Alloy 16 | 0.002 | 0.002 | 1.41 | — | 1.69 | 0.011 | — | — |
| | Alloy 17 | 0.002 | 0.002 | 1.42 | — | 1.73 | 0.054 | — | — |
| | Alloy 18 | 0.002 | 0.002 | 1.42 | — | 1.58 | 0.001 | — | — |
| | Alloy 19 | 0.002 | 0.002 | 1.35 | — | 1.63 | 0.001 | — | — |
| | Alloy 20 | 0.002 | 0.002 | 1.33 | — | 1.61 | 0.001 | — | — |
| | Alloy 21 | 0.002 | 0.002 | 1.44 | — | 2.38 | 0.002 | — | — |

TABLE 2

| Category | No. | Tensile strength | 0.02% yield stress | Charpy impact strength | Pitting potential | Microstructure | Martensite finish temperature |
|---|---|---|---|---|---|---|---|
| Invented alloy | 1 | Accepted | Accepted | Accepted | Accepted | Accepted | Accepted |
| | 2 | Accepted | Accepted | Accepted | Accepted | Accepted | Accepted |
| | 3 | Accepted | Accepted | Accepted | Accepted | Accepted | Accepted |
| | 4 | Accepted | Accepted | Accepted | Accepted | Accepted | Accepted |
| | 5 | Accepted | Accepted | Accepted | Accepted | Accepted | Accepted |
| | 6 | Accepted | Accepted | Accepted | Accepted | Accepted | Accepted |
| | 7 | Accepted | Accepted | Accepted | Accepted | Accepted | Accepted |
| | 8 | Accepted | Accepted | Accepted | Accepted | Accepted | Accepted |
| | 9 | Accepted | Accepted | Accepted | Accepted | Accepted | Accepted |
| | 10 | Accepted | Accepted | Accepted | Accepted | Accepted | Accepted |
| | 11 | Accepted | Accepted | Accepted | Accepted | Accepted | Accepted |
| Comparative alloy | 12 | Accepted | Accepted | Accepted | Accepted | Accepted | Rejected |
| | 13 | Rejected | Rejected | Accepted | Accepted | Rejected | Accepted |
| | 14 | Accepted | Accepted | Accepted | Accepted | Accepted | Rejected |
| | 15 | Rejected | Rejected | Accepted | Rejected | Rejected | Rejected |
| | 16 | Accepted | Accepted | Rejected | Accepted | Accepted | Rejected |
| | 17 | Rejected | Rejected | Rejected | Accepted | Rejected | Rejected |
| | 18 | Rejected | Rejected | Accepted | Accepted | Rejected | Rejected |
| | 19 | Rejected | Rejected | Accepted | Accepted | Rejected | Rejected |
| | 20 | Accepted | Accepted | Rejected | Accepted | Rejected | Rejected |
| | 21 | Accepted | Accepted | Rejected | Accepted | Rejected | Rejected |

Example 2

Examination of Heat Treatment Conditions

Heat treatment conditions for solution heat treatment and aging heat treatment were examined using invented alloys 1, 3, 5, and 7. As a result, when the solution treatment temperature exceeded 1025° C., excessive residual austenite phase formation took place and thus tensile strength, 0.02% yield stress, Charpy impact strength, and microtissue observation results were rejected. When the solution temperature was below 925° C., the insoluble precipitate was increasingly formed, resulting in non-uniform formation of microtissue. In addition, the mechanical strength results were rejected. That is, it was confirmed that the temperature for solution heat treatment is preferably 925° C. to 1025° C. and more preferably 950° C. to 1000° C.

Figure 8:
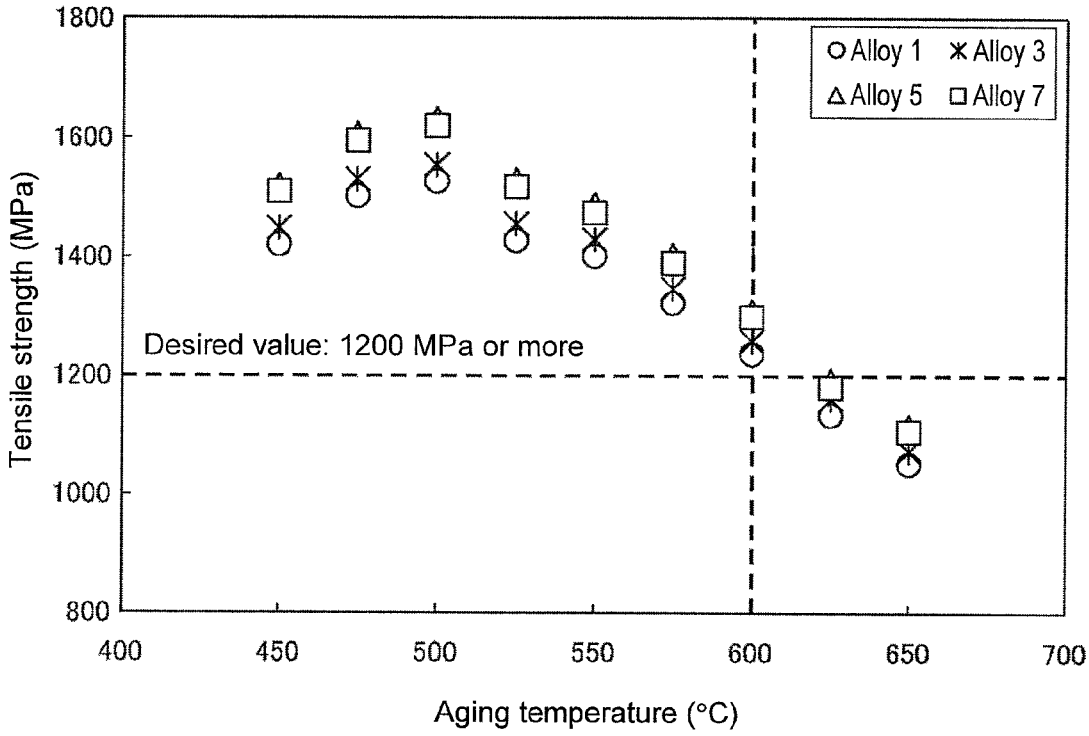
FIG. 8 is a chart showing the relationship of aging temperature and tensile strength for the alloys of the present invention.
Figure 9:
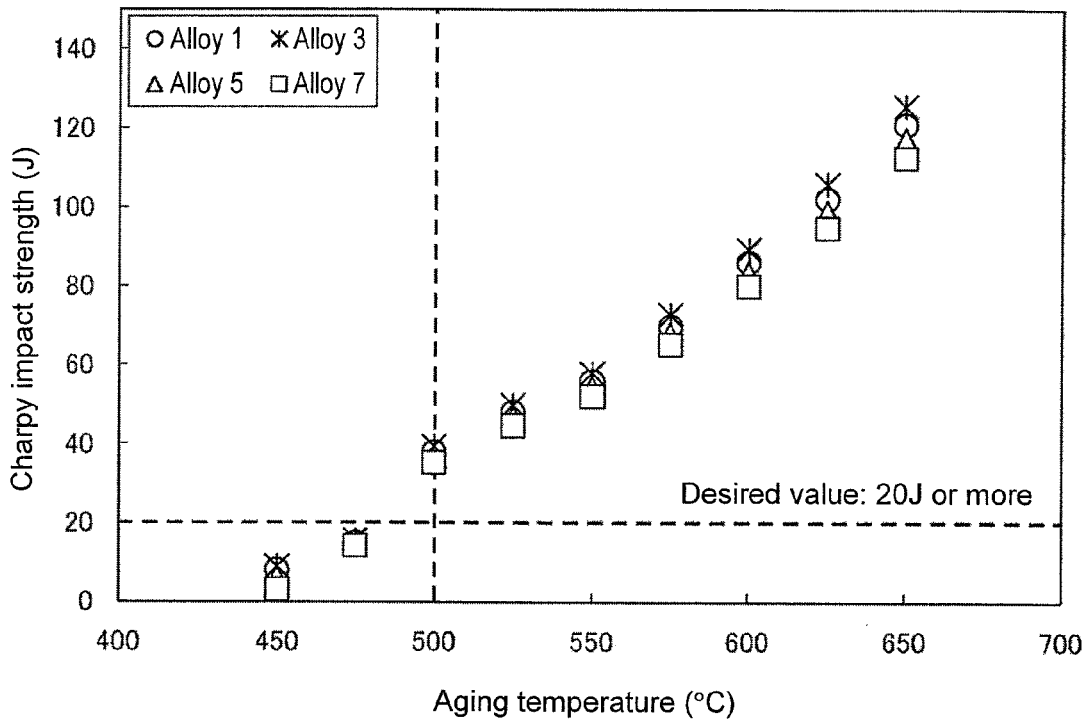
FIG. 9 is a chart showing the relationship of aging temperature and Charpy impact strength for the alloys of the present invention.

FIG. 8 is a chart showing the relationship between tensile strength and aging temperature. FIG. 9 is a chart showing the relationship between Charpy impact strength and aging temperature. As shown in FIGS. 8 and 9, when the aging temperature exceeded 600° C., tensile strength results were rejected. Meanwhile, when the aging temperature was below 500° C., Charpy impact strength results were rejected. That is, it was confirmed that aging temperature is preferably 500° C. to 600° C. In view of the balance between tensile strength and Charpy impact strength, aging temperature is more preferably 530° C. to 570° C. and further preferably 540° C. to 560° C.

Example 3

A long blade for a steam turbine composed of the alloy of the present invention is described below. In this embodiment, an axial-entry-type long blade for a steam turbine having a blade length of 48 inches was produced using alloy 1 as an invented material listed in table 1. A long blade was prepared by the following manner. First, carbon vacuum deoxidation was carried out at a high vacuum of $5.0\times10^{-3}$ Pa or less to induce a chemical reaction of C+O→CO so as to deoxidize molten steel. Subsequently, shaping was carried out via cogging to obtain an electrode bar. Electroslag remelting was carried out to obtain a high-quality steel ingot by immersing the obtained electrode bar in molten slag, applying current to the electrode bar, allowing the electrode bar to be self-melted by Joule heat, and solidifying the molten electrode bar into an ingot using a water cooling mold. Thereafter, hot forging and closed die forging using a 48-inch-blade-type die were carried out in such order. Then, solution treatment was carried out by heating at 980° C. for 2.0 hours, followed by forced rapid cooling with a blower. The resultant was processed into a predetermined form via a cutting step, followed by aging treatment via heating at 550° C. for 4.0 hours and air cooling. Straightening and surface polishing were carried out for final finish processing. Thus, a 48-inch-long blade was obtained.

Test pieces were collected from the tip, center, and root portions of the long blade for a steam turbine obtained above and subjected to evaluation tests in the manner described in Example 1. The collected test pieces were longitudinal pieces of the blade.

As a result of microtissue observation, the uniform martensitic structure was observed in each part. No residual austenite was observed and the mass percentage of δ ferrite was 1.0% or less. In addition, tensile strength, 0.02% yield stress, Charpy impact strength, pitting potential, and martensite finish temperature met all requirements, regardless of sampling sites.

The precipitate hardening stainless steel of the present invention has excellent martensitic structure stability and is a precipitate hardening stainless steel having high degrees of strength, toughness, and corrosion resistance. Thus, it can be used for long blades for steam turbines, blades for gas turbine compressors, and the like.

All references, including any publications, patents or patent applications cited in this specification are hereby incorporated by reference in their entirely.

DESCRIPTION OF SYMBOLS

1: Blade profile
2: Blade root
3: Erosion shield
4: Stub
5: Shroud
10, 31: Long blade for steam turbine
20: Integrated low-pressure stage turbine rotor
21: Bracket of long blade for steam turbine
30: Integrated low-pressure stage turbine
32: Nozzle
33: Bearing

What is claimed is:

1. A precipitate hardening stainless steel, which further comprises C at 0.05 mass % or less, N at 0.05 mass % or less, Cr at 10.0 mass % to 14.0 mass %, Ni at 8.5 mass % to 11.5 mass %, Mo at 0.5 mass % to 3.0 mass %, Ti at 1.5 mass % to 2.0 mass %, Al at 0.25 mass % to 1.00 mass %, Si at 0.5 mass % or less, Mn at 1.0 mass % or less, and W, wherein the total amount of Mo and W is equivalent to the amount of Mo in a case in which only Mo is added, and a balance composed of Fe and inevitable impurities.

2. The precipitate hardening stainless steel of claim 1, which further comprises at least one member selected from Nb, V and Ta, at 0.5 mass % or less.

3. The precipitate hardening stainless steel of claim 1, which further comprises Co at 1.0 mass % or less and Re at 1.0 mass % or less.

4. The precipitate hardening stainless steel of claim 1, wherein the inevitable impurities include at least one member selected from S, P, Sb, Sn, and As, and the following conditions are satisfied: S: 0.5 mass % or less; P: 0.5 mass % or less; Sb: 0.1 mass % or less; Sn: 0.1 mass % or less; and As: 0.1 mass % or less.

5. The precipitate hardening stainless steel of claim 1, wherein the stainless steel is subject to a solution treatment, a temperature range for the solution treatment is from 925° C. to 1025° C., the stainless steel is subject to an aging treatment, and a temperature range for the aging treatment is from 500° C. to 650° C.

6. A long blade for a steam turbine, wherein the precipitate hardening stainless steel of claim 1 is used.

7. A turbine rotor equipped with the long blade for a steam turbine of claim 6.

8. A steam turbine equipped with the turbine rotor of claim 7.

9. A steam turbine power plant equipped with the steam turbine of claim 8.

10. A precipitate hardening stainless steel, which comprises C at 0.05 mass % or less, N at 0.05 mass % or less, Cr at 10.0 mass % to 14.0 mass %, Ni at 8.5 mass % to 11.5 mass %, Mo at 0.5 mass % to 3.0 mass %, Ti at 1.5 mass % to 2.0 mass %, Al at 0.25 mass % to 1.00 mass %, Si at 0.5 mass % or less, and Mn at 1.0 mass % or less, and the balance is composed of Fe and inevitable impurities;

wherein both parameter A for martensite finish temperature and parameter B for martensitic structure stability as defined below are satisfied:

$$\text{Parameter } A = 127.7 - 4.20\text{Cr \%} - 6.38\text{Ni \%} - 3.09\text{Mo \%} - 2.67\text{Al \%} - 14.7\text{W \%} - 3.41\text{Mn \%} - 3.57\text{Si \%} - 1.65\text{Co \%} - 2.32\text{Ti \%} - 221.5\text{C \%} - 321.4\text{N \%} > 2.5; \text{ and}$$

$$\text{Parameter } B = (\text{Cr \%} + 2.2\text{Si \%} + 1.1\text{Mo \%} + 0.6\text{W \%} + 4.3\text{Al \%} + 2.1\text{Ti \%})/(\text{Ni \%} + 31.2\text{C \%} + 0.5\text{Mn \%} + 27\text{N \%} + 1.1\text{Co \%}) < 2.0.$$

11. The precipitate hardening stainless steel of claim 10, which further comprises at least one member selected from Nb, V and Ta, at 0.5 mass % or less.

12. The precipitate hardening stainless steel of claim 10, which further comprises Co at 1.0 mass % or less and Re at 1.0 mass % or less.

13. The precipitate hardening stainless steel of claim 10, wherein the inevitable impurities include at least one member selected from S, P, Sb, Sn, and As, and the following conditions are satisfied: S: 0.5 mass % or less; P: 0.5 mass % or less; Sb: 0.1 mass % or less; Sn: 0.1 mass % or less; and As: 0.1 mass % or less.

14. The precipitate hardening stainless steel of claim 10, wherein the stainless steel is subject to a solution treatment, a temperature range for the solution treatment is from 925° C. to 1025° C., the stainless steel is subject to an aging treatment, and a temperature range for the aging treatment is from 500° C. to 650° C.

15. A long blade for a steam turbine, wherein the precipitate hardening stainless steel of claim 10 is used.

16. A turbine rotor equipped with the long blade for a steam turbine of claim 15.

17. A steam turbine equipped with the turbine rotor of claim 16.

18. A steam turbine power plant equipped with the steam turbine of claim 17.

* * * * *